US009322330B2

(12) United States Patent
Giovenga

(10) Patent No.: US 9,322,330 B2
(45) Date of Patent: Apr. 26, 2016

(54) MECHANICAL SYSTEM OF LINKING TO THE MASTER CONNECTING ROD FOR TRANSMISSION OF THE MOTION OF THE PISTONS OF AN INTERNAL COMBUSTION ENGINE TO CONTROL AND CHANGE THE COMPRESSION RATIO

(71) Applicant: Pietro Giovenga, Rome (IT)

(72) Inventor: Pietro Giovenga, Rome (IT)

( * ) Notice: Subject to any disclaimer, the term of this patent is extended or adjusted under 35 U.S.C. 154(b) by 13 days.

(21) Appl. No.: 14/333,937

(22) Filed: Jul. 17, 2014

(65) Prior Publication Data

US 2014/0326220 A1 Nov. 6, 2014

Related U.S. Application Data

(63) Continuation-in-part of application No. 13/261,559, filed as application No. PCT/IT2011/000171 on May 23, 2011, now abandoned.

(30) Foreign Application Priority Data

Jun. 21, 2010 (IT) ..... RM2010A0336

(51) Int. Cl.
*F02B 75/04* (2006.01)
*F02B 75/32* (2006.01)

(52) U.S. Cl.
CPC ..... *F02B 75/04* (2013.01); *F02B 75/32* (2013.01)

(58) Field of Classification Search
CPC .. F02B 75/04; F02B 2075/025; F02B 75/047; F02B 75/246; F02B 75/32; F01B 2003/0097; F02D 15/04; F02F 7/00
USPC ..... 123/48 R, 48 B, 78 R, 78 BA, 78 E, 78 F
See application file for complete search history.

(56) References Cited

U.S. PATENT DOCUMENTS

| | | | | |
|---|---|---|---|---|
| 2,383,648 | A | 8/1945 | Hawkins | |
| 2,401,188 | A | 5/1946 | Prince | |
| 2,684,053 | A * | 7/1954 | Perdelli | F01B 7/04 123/53.4 |
| 2,822,791 | A * | 2/1958 | Biermann | F02B 75/045 123/197.4 |
| 3,369,733 | A * | 2/1968 | Campbell | F02B 75/282 123/196 R |
| 3,524,435 | A | 8/1970 | Hambric | |
| 3,608,530 | A * | 9/1971 | Wenzel | F02B 25/00 123/53.4 |
| 4,281,628 | A | 8/1981 | Doundoulakis | |
| 4,413,486 | A | 11/1983 | Irwin | |
| 4,917,066 | A * | 4/1990 | Freudenstein | F01B 7/12 123/197.4 |

(Continued)

FOREIGN PATENT DOCUMENTS

| | | | |
|---|---|---|---|
| DE | 7908941 | U1 | 12/1979 |
| FR | 936514 | A | 7/1948 |
| GB | 354781 | A | 8/1931 |
| JP | 08312460 | A * | 11/1996 |

*Primary Examiner* — Stephen K Cronin
*Assistant Examiner* — Long T Tran
(74) *Attorney, Agent, or Firm* — Egbert Law Offices, PLLC

(57) ABSTRACT

The present invention relates to the reciprocating internal combustion engine sector and more specifically concerns a mechanical system of linking to the master connecting rod for transmission of the motion of the pistons of an internal combustion engine consisting of a lever, which can be completely rigid or made up of a flexible part and a rigid part, and a connecting rod connected to it that rotates a crankshaft; two coaxial pistons with opposed heads that act practically in the same cylinder and have opposed combustion chambers are connected by two small connecting rods at the top of the said lever, which has its fulcrum—fixed or moving—in the engine bedplate.

7 Claims, 26 Drawing Sheets

(56) References Cited

U.S. PATENT DOCUMENTS 5,025,759 A 6/1991 Wenzel et al.
5,189,994 A * 3/1993 Gindentuller ..... F01B 9/02 123/197.4
6,035,733 A * 3/2000 Yoshizawa ..... F01B 9/02 74/45
6,701,885 B2 * 3/2004 Klomp ..... F02B 75/045 123/197.4
7,685,980 B2 3/2010 Lee et al.
2008/0211447 A1 * 9/2008 Prasanna ..... H02K 49/046 318/701
2010/0300410 A1 * 12/2010 Arnold ..... F01B 3/0002 123/48 B
2011/0120421 A1 * 5/2011 Engineer ..... F02B 75/045 123/48 B

* cited by examiner

G-G

M-M position: maximum RC

MECHANICAL SYSTEM OF LINKING TO THE MASTER CONNECTING ROD FOR TRANSMISSION OF THE MOTION OF THE PISTONS OF AN INTERNAL COMBUSTION ENGINE TO CONTROL AND CHANGE THE COMPRESSION RATIO

CROSS-REFERENCE TO RELATED APPLICATIONS

The present application is a continuation-in-part of U.S. application Ser. No. 13/261,559, filed on Jan. 4, 2013, and entitled "New Internal Combustion Engine at Alternating Cycle with Controlled Variable Compression Ratio-CVCR", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the reciprocating internal combustion engine sector and more specifically concerns a mechanical system of linking to the master connecting rod for transmission of the motion of the pistons of an internal combustion engine consisting of a lever, which can be completely rigid or made up of a flexible part and a rigid part, and a connecting rod connected to it that rotates a crankshaft; two coaxial pistons with opposed heads that act practically in the same cylinder and have opposed combustion chambers are connected by two small connecting rods at the top of the said lever, which has its fulcrum—fixed or moving—in the engine bedplate.

2. Description of Related Art Including Information Disclosed Under 37 CFR 1.97 and 37 CFR 1.98.

In the current state of the art, in the internal combustion engine sector, mechanical systems of linking to the master connecting rod using the structure of the crank mechanism with lever without changing its cycle are disclosed in patents GB354781, DE7908941, U.S. Pat. No. 2,383,648, FR936514, U.S. Pat. No. 5,025,759. The said patents present the problem that they have a system of linking to the master connecting rod consisting of levers that soon break because of the bending they are subjected to; moreover, the said systems do not lend themselves to controlled variation of the compression ratio.

BRIEF SUMMARY OF THE INVENTION

It is an object of the present invention to make a mechanical system of linking to the master connecting rod for transmission of the motion of the pistons of an internal combustion engine that has:

- a much wider utilization flexibility of the internal combustion engines known in the state of the art through a system of linking to the master connecting rod that will allow the compression ratio (CR) of the engine to be changed continuously, so as to always have a maximum coefficient of performance (therefore maximum power and low consumption) in relation to the required power needs;
- low consumption;
- greater general compactness as a result of the smaller size of the crankshaft and a decrease of pieces compared to a similar internal combustion engine;
- better torque and power curves than current engines, for the same consumption, due to adaptation of the compression ratio to every speed depending on the required power;
- no pump effect in the crankcase;
- reduced piston friction on the cylinder liner.

It is another object of the present invention to make a mechanical system of linking to the master connecting rod for transmission of the reciprocating motion of the pistons to the engine shaft that will allow the latter to keep its position unchanged as regards all the other parts of the engine, in particular, the transmission of motion to the movement system for opening and closing the inlet and exhaust valves and the ignition management system, thereby also automatically allowing adaptation of the CR so making it possible to use fuels with different amounts of octane (for petrol) and different self-ignition abilities for diesel fuels and heavy oils.

BRIEF DESCRIPTION OF THE SEVERAL VIEWS OF THE DRAWINGS

Further features and advantages of the invention will be apparent from the description of a preferred, but not exclusive, embodiment of the mechanical system of linking to the master connecting rod for transmission of the motion of the pistons of an internal combustion engine that is the subject of the present patent application, illustrated by way of non-limiting example in the drawing units in which:

FIG. 1 shows an axonometric view of an internal combustion engine with four pistons and two cylinders with the new mechanical system of linking to the master connecting rod for transmission of the motion of the pistons, without the heads that remain conventional, and consisting of:

Figure 1:
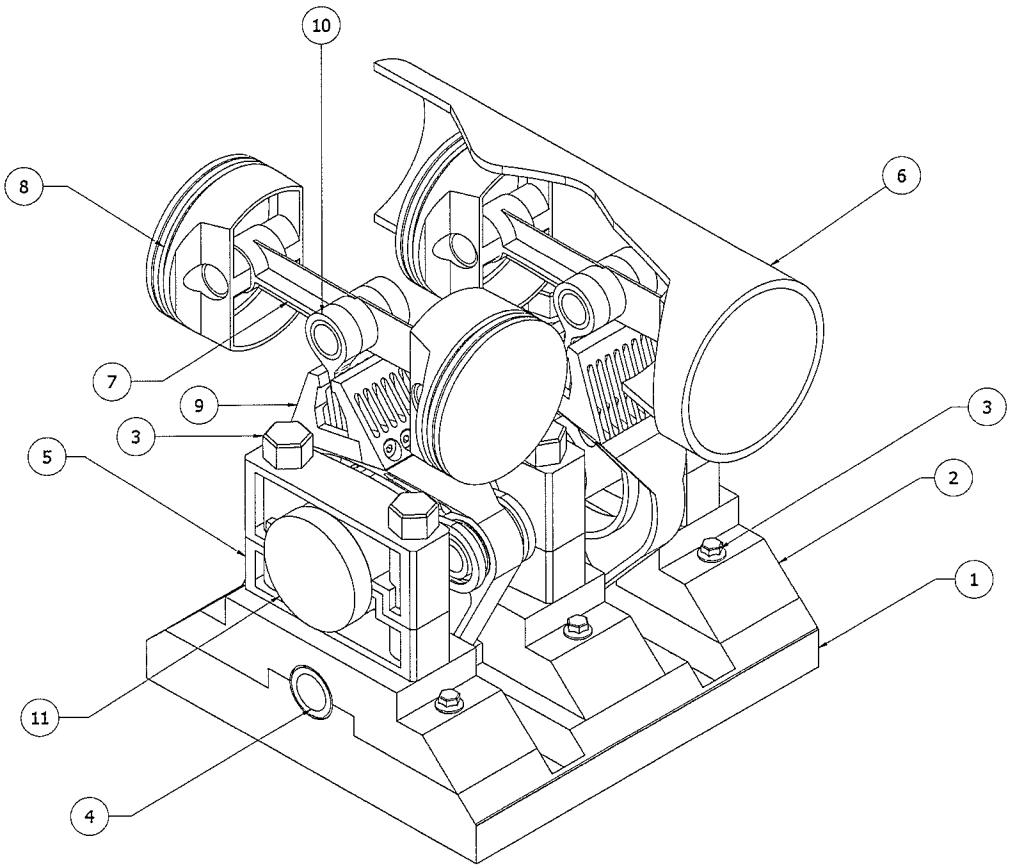

- the fixed bedplate (1)
- the support block of the lever fulcrum pin (2)
- the clamping bolts (3)
- the lever fulcrum pin (4)
- the lower bearing (5) of the crankshaft (11)
- the cylinder (6)
- the connecting rod (7) of the piston (8)
- the piston (8)
- the rigid part (9) of the lever for motion transfer
- the flexible part (10) of the lever for motion transfer
- the crankshaft (11).

Figure 2:
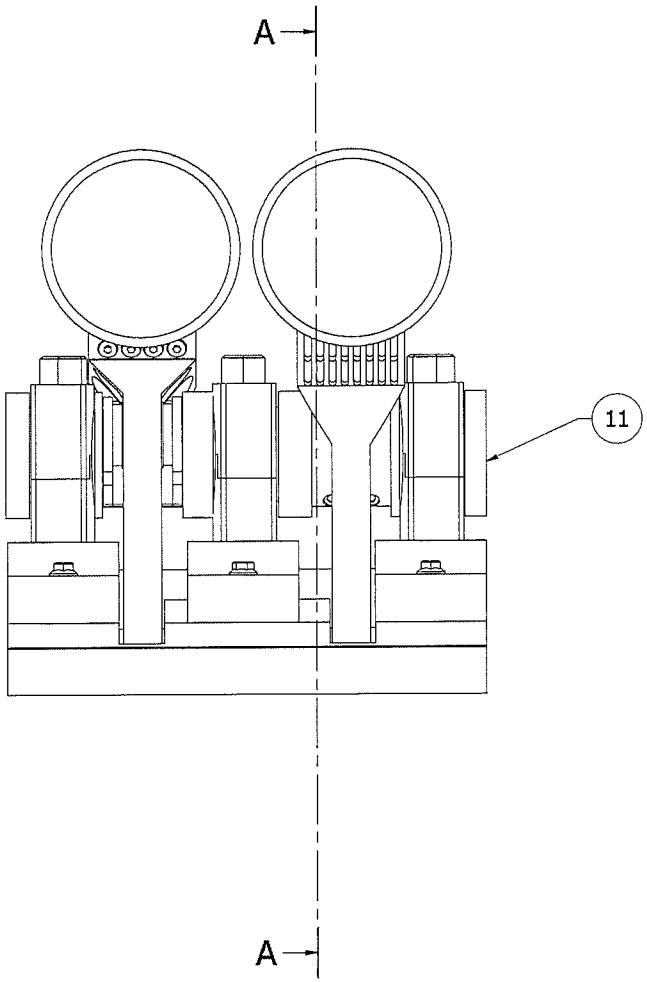
Figure 3:
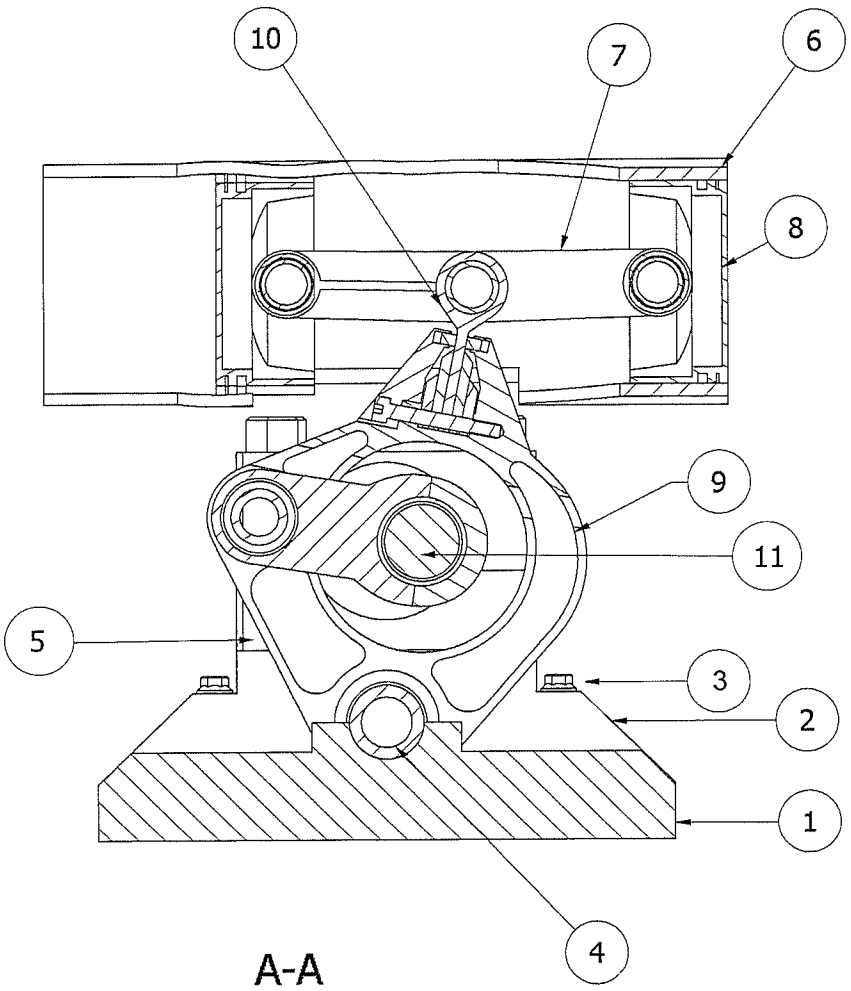

FIG. 2 shows a side view of an internal combustion engine with four pistons and two cylinders in which is indicated:

- with a broken line, the cross section plane A-A shown in FIG. 3;
- the crankshaft (11).

FIG. 3 shows, with the A-A vertical section compared to the bedplate, the internal combustion engine with four pistons and two cylinders in which are highlighted:

- the fixed bedplate (1)
- the support block of the lever fulcrum pin (2)
- the clamping bolts (3)

the lever fulcrum pin (4)
the lower bearing (5) of the crankshaft (11)
the cylinder (6)
the connecting rod (7) of the piston (8)
the piston (8)
the rigid part (9) of the lever for motion transfer
the flexible part (10) of the lever for motion transfer
the crankshaft (11).

Figure 4:
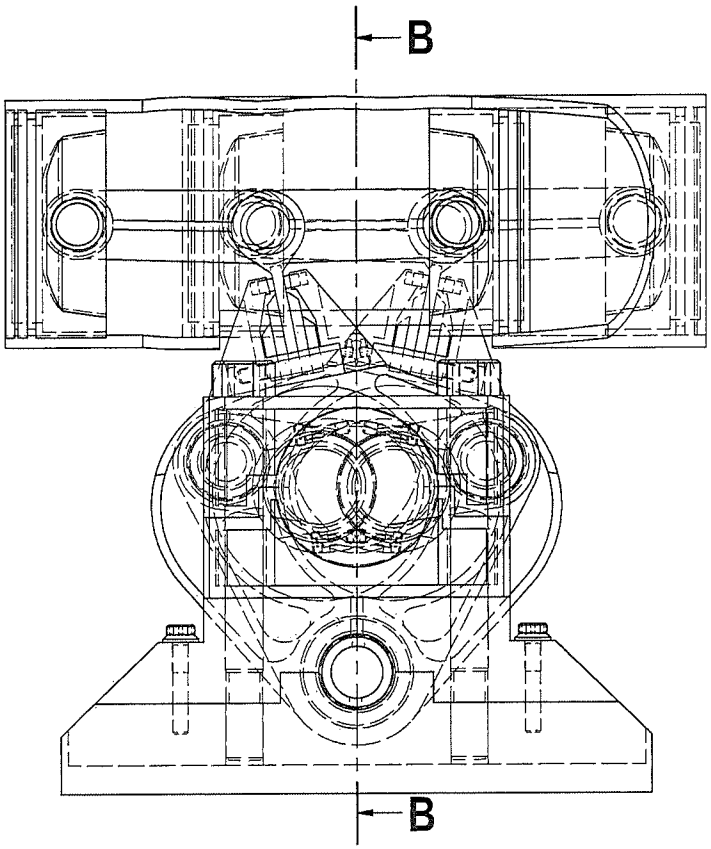
Figure 5:
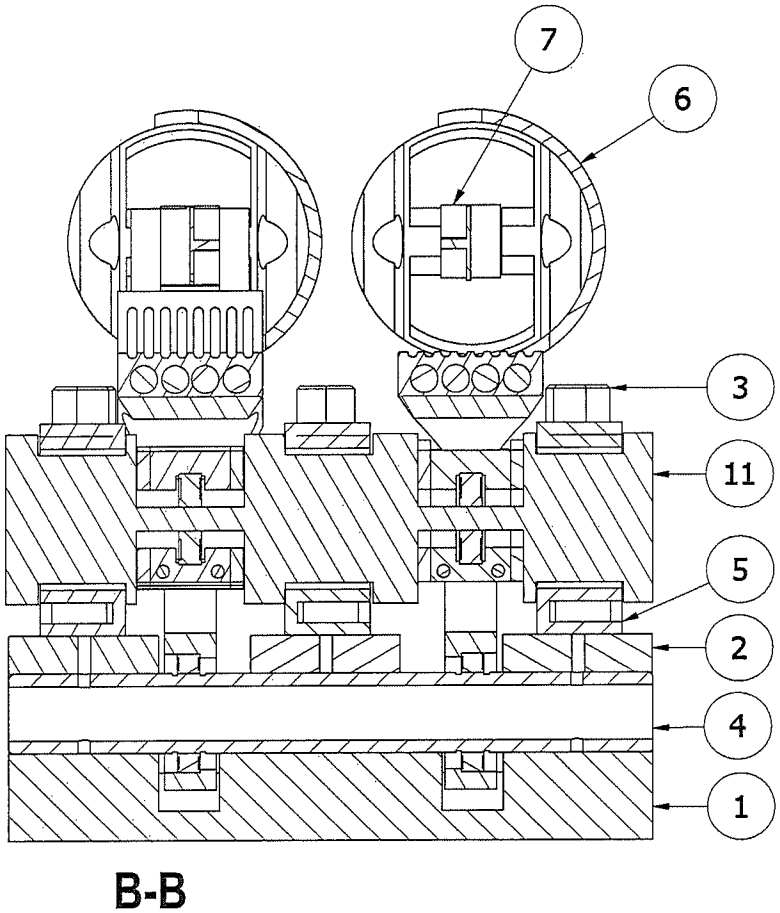

FIG. 4 shows a front view of the internal combustion engine with four pistons and two cylinders in which all the internal parts of the engine are highlighted with see-through broken lines and the vertical cross section plane B-B of the engine shown in FIG. 5 is drawn.

FIG. 5 shows, in B-B vertical cross section compared to the axis of the crankshaft, the internal combustion engine with four pistons and two cylinders in which are highlighted:
the fixed bedplate (1)
the support block of the lever fulcrum pin (2)
the clamping bolts (3) of the crankshaft bearing
the lever fulcrum pin (4)
the lower bearing (5) of the crankshaft (11)
the cylinder (6)
the connecting rod (7) of the piston (8)
the crankshaft (11).

Figure 6:
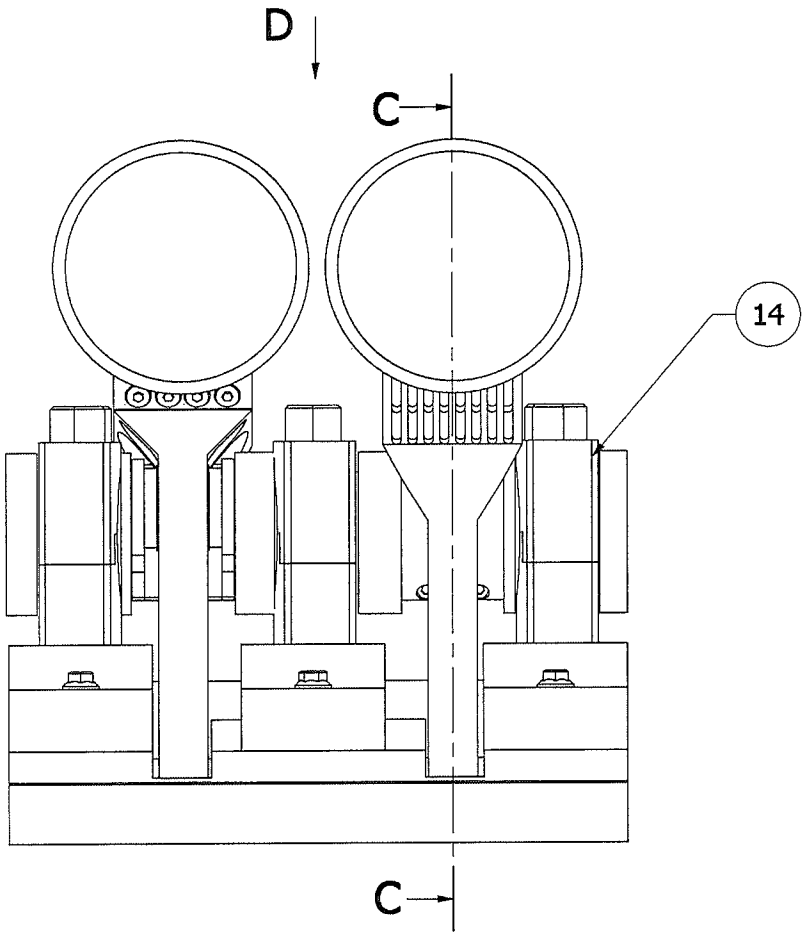
Figure 7:
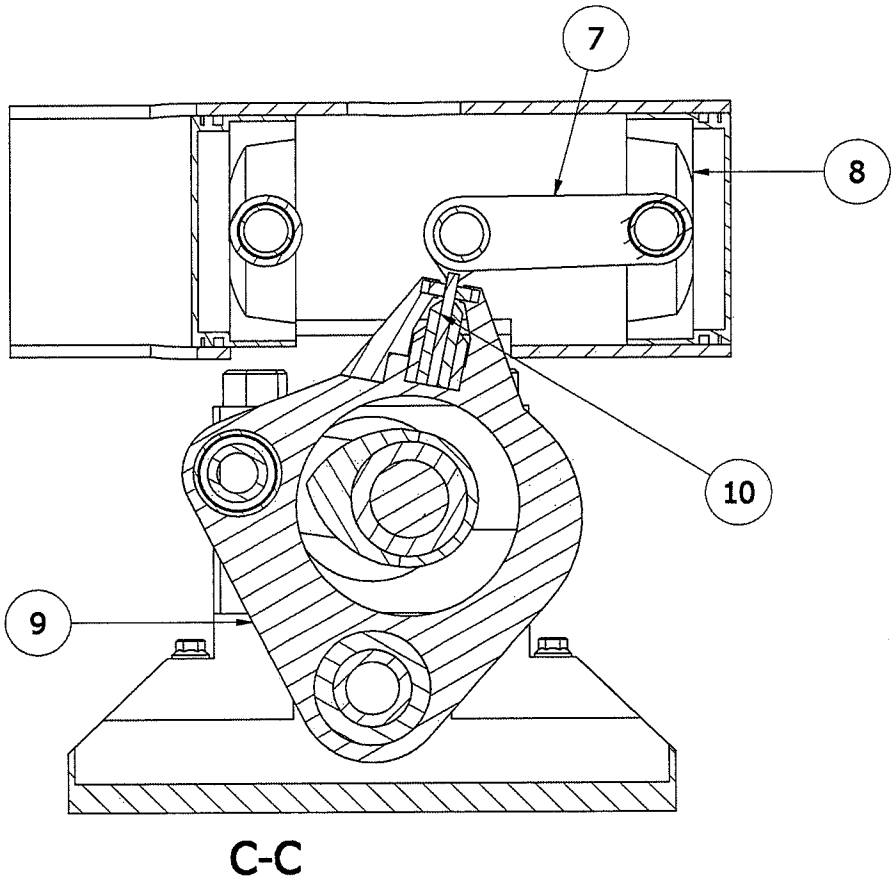
Figure 8:
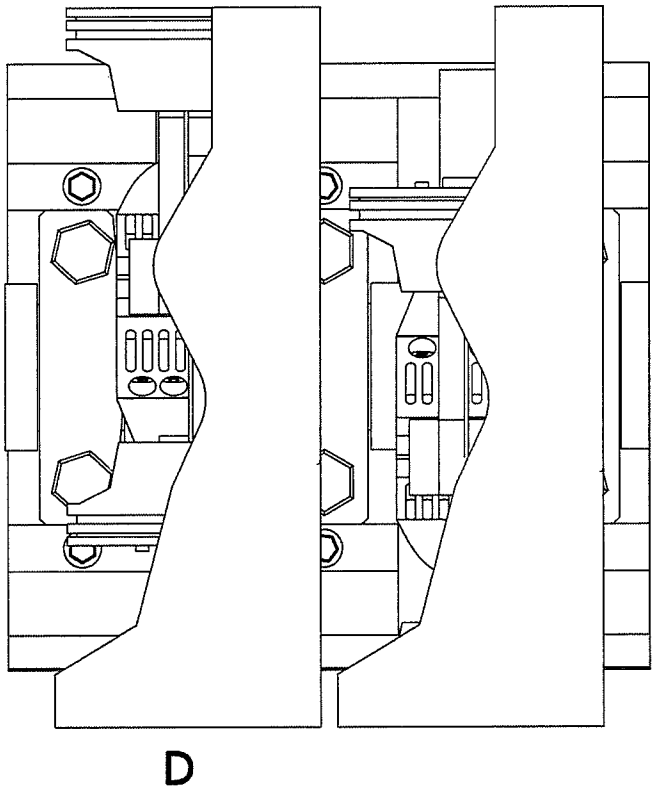

FIG. 6 shows:
the direction of "viewpoint" D from which the internal combustion engine with four pistons and two cylinders is seen as represented in FIG. 8;
the vertical plane C-C of vertical section perpendicular to the axis of the crankshaft, whose section is represented in FIG. 7;
the upper bearing (14) of the crankshaft (11).

FIG. 7 shows the cross section, as per FIG. 6, of the internal combustion engine with four pistons and two cylinders in which are highlighted:
the connecting rod (7) of the piston (8);
the piston (8);
the flexible part (10) of the lever for motion transfer;
the rigid part (9) of the lever for motion transfer.

FIG. 8 shows the top view of the internal combustion engine with four pistons and two cylinders from "viewpoint D".

Figure 9:
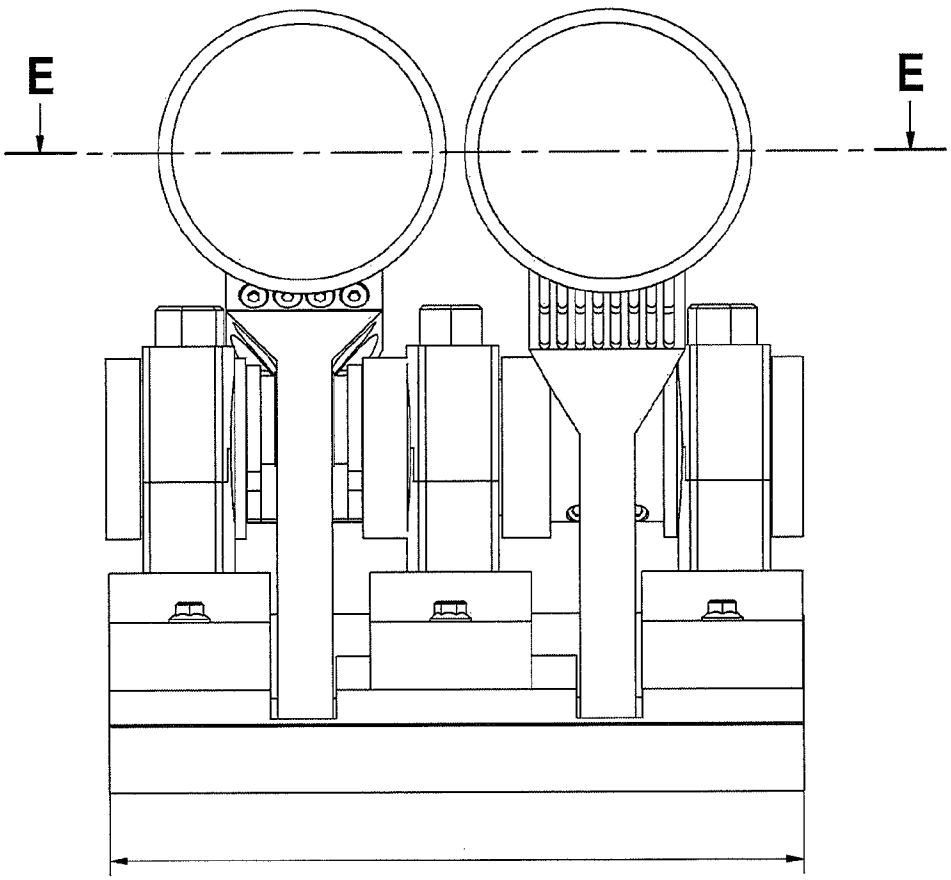
Figure 10:
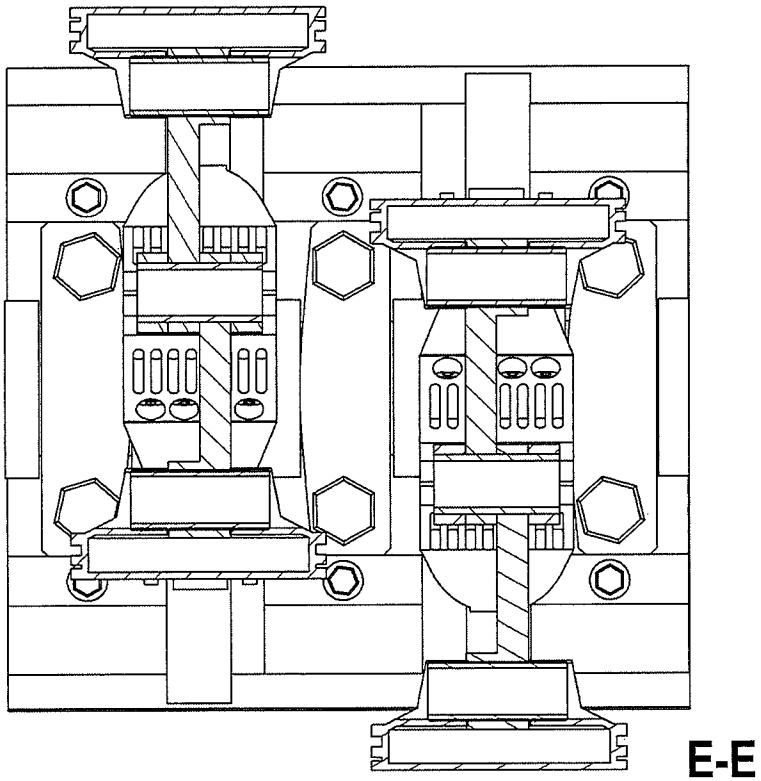

FIG. 9 shows the horizontal section plane E-E of the internal combustion engine with four pistons and two cylinders, whose section is represented in FIG. 10.

FIG. 10 shows the horizontal section on plane E-E of the internal combustion engine with four pistons and two cylinders.

Figure 11:
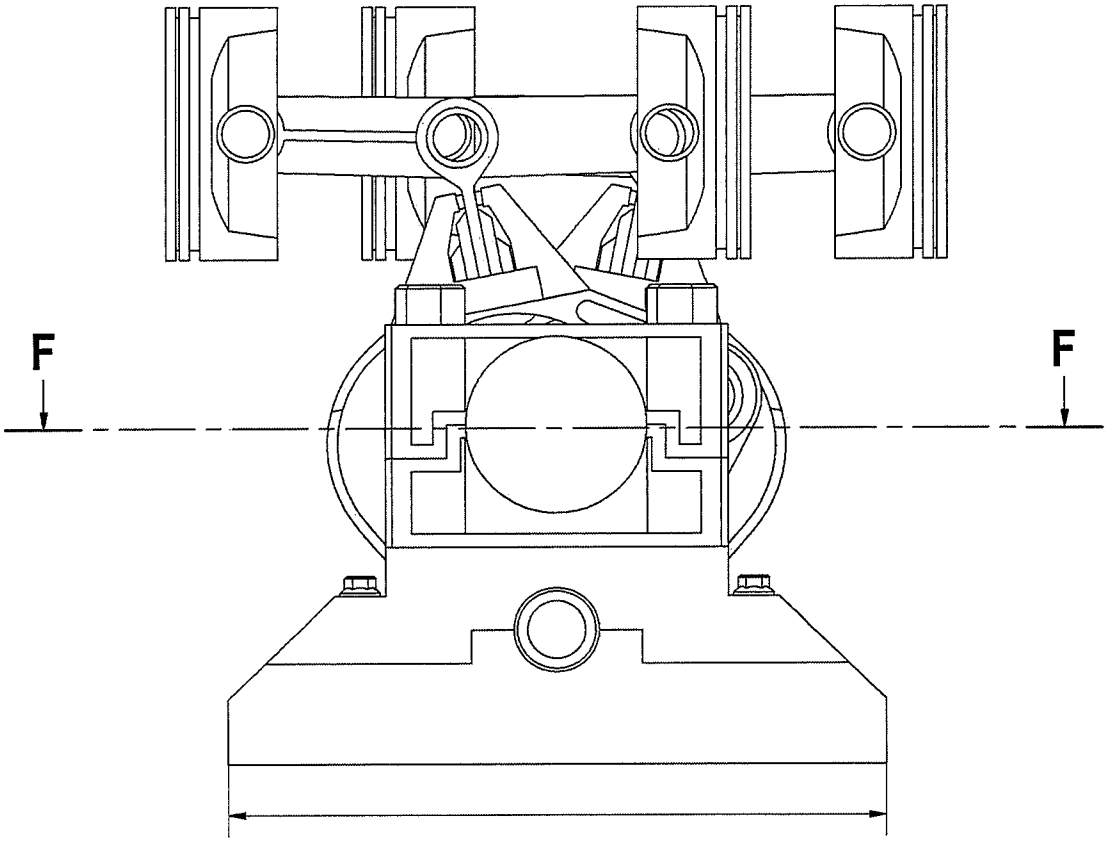
Figure 12:
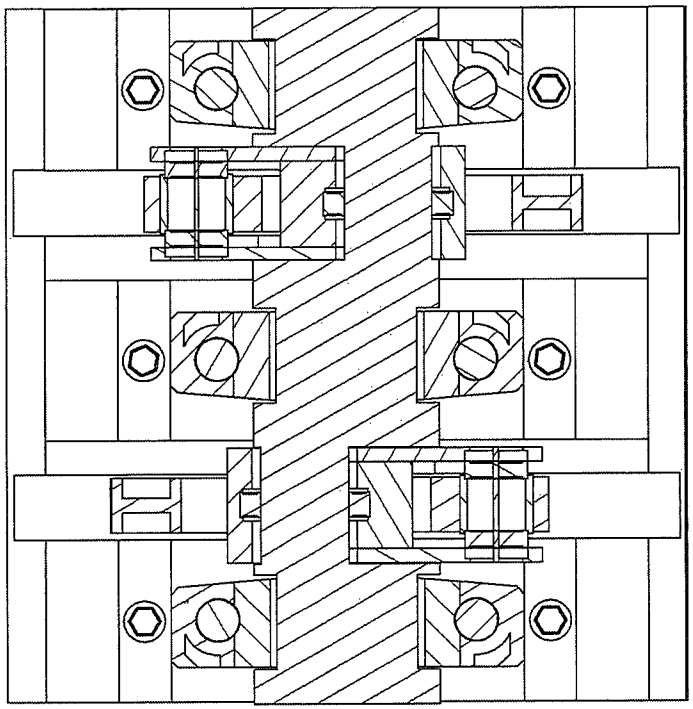

FIG. 11 shows the horizontal section plane F-F of the internal combustion engine with four pistons and two cylinders, whose section is represented in FIG. 12.

FIG. 12 shows the horizontal section on plane F-F of the internal combustion engine with four pistons and two cylinders, whose section is represented in FIG. 11.

Figure 13:
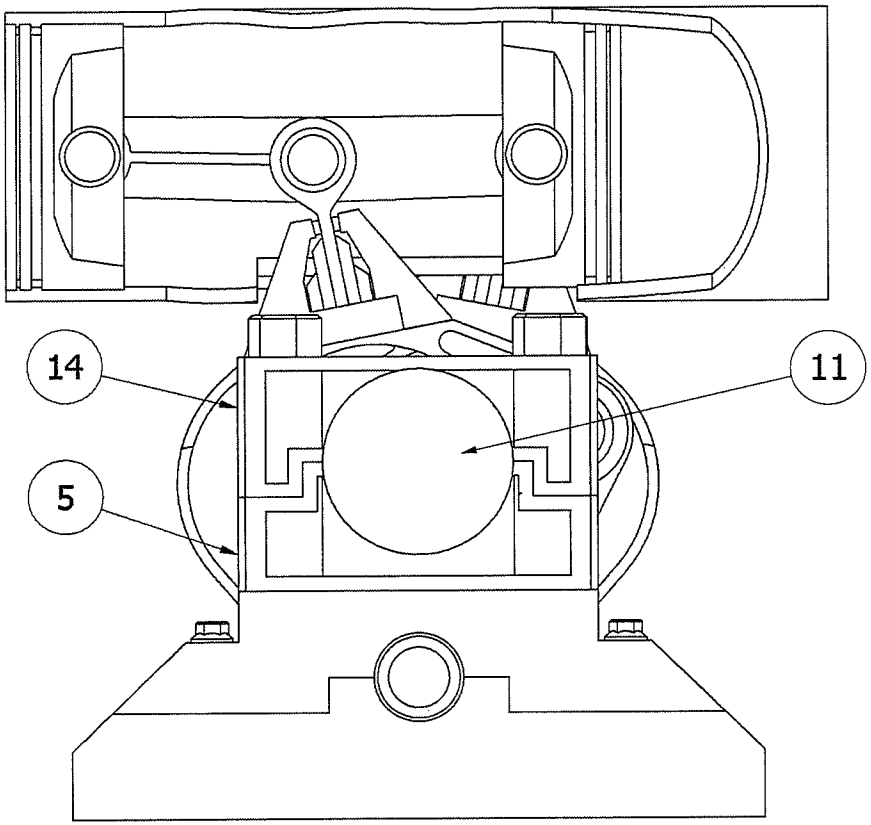

FIG. 13 shows a front view of the engine according to the axis of the engine where the following are highlighted:
the lower bearing (5) of the crankshaft (11);
the crankshaft (11);
the upper bearing (14) of the crankshaft (11).

Figure 14:
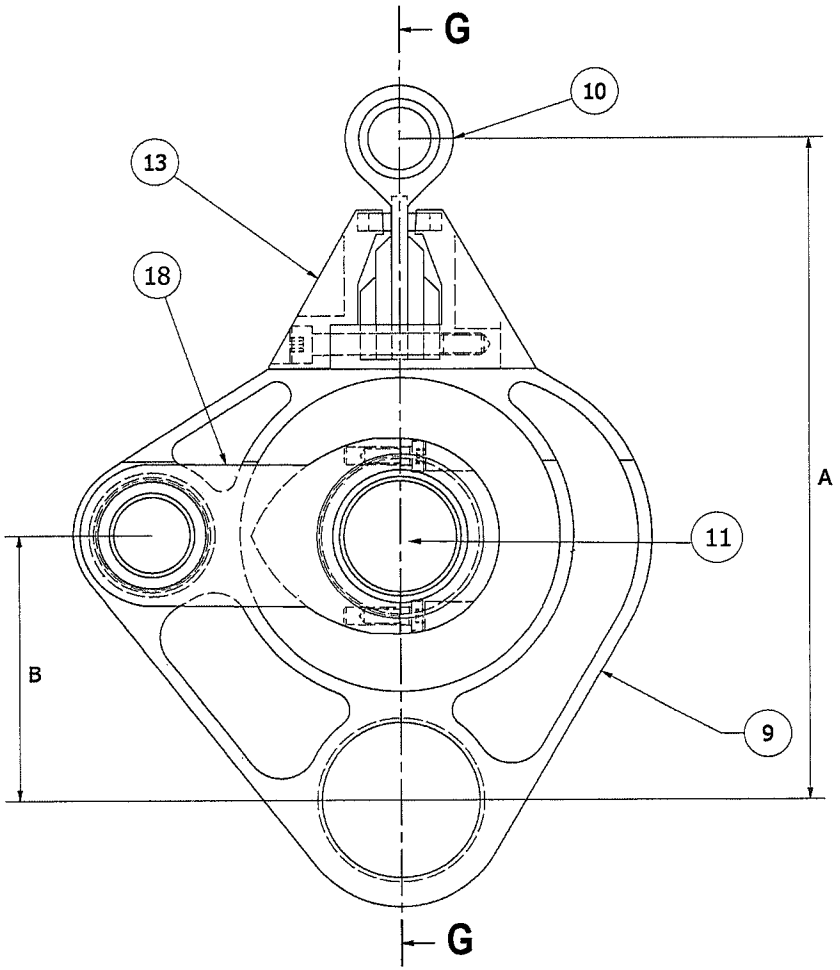
Figure 15:
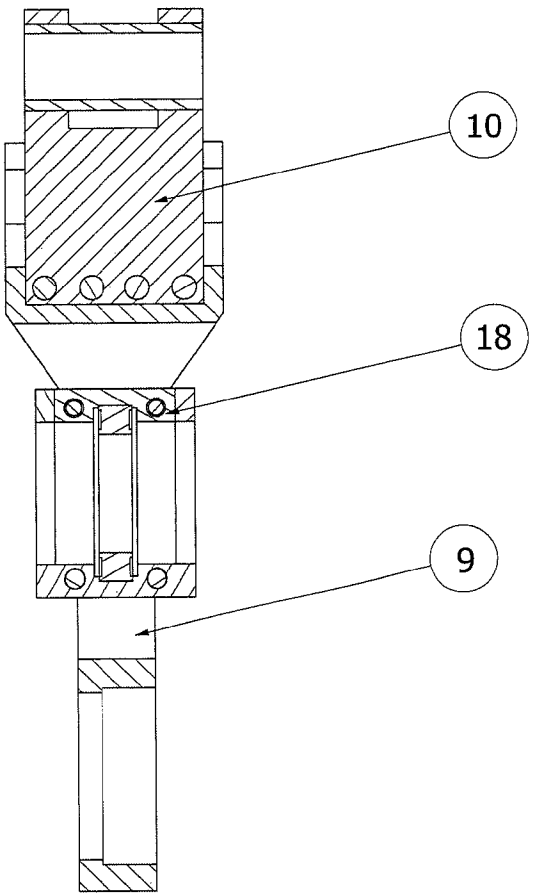

FIG. 14 shows:
the vertical section plane G-G, whose section is represented in FIG. 15;
the favourable lever arm A and the arm of force of lever B;
the connecting rod (18) that connects the lever to the crankshaft (11);
the rigid part (9) of the lever;
the flexible part (10) of the lever;
the side stops (13) that limit the bending of the flexible part (10) of the lever.

FIG. 15 shows section G-G of the lever as indicated in FIG. 14 in which are highlighted:
the rigid part (9) of the lever;
the flexible part (10) of the lever;
the connecting rod (18) that connects the lever to the crankshaft (11).

Figure 16:
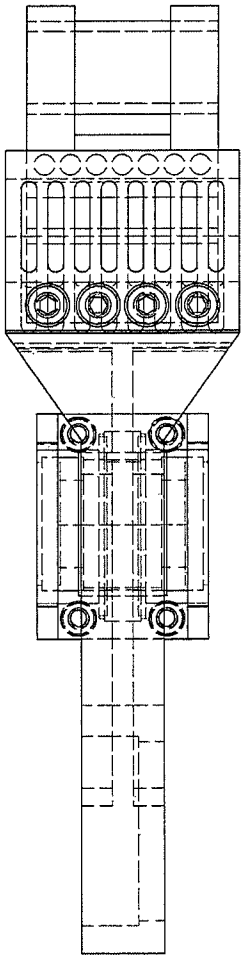

FIG. 16 shows a see-through side view of the lever as per FIG. 14.

Figure 17:
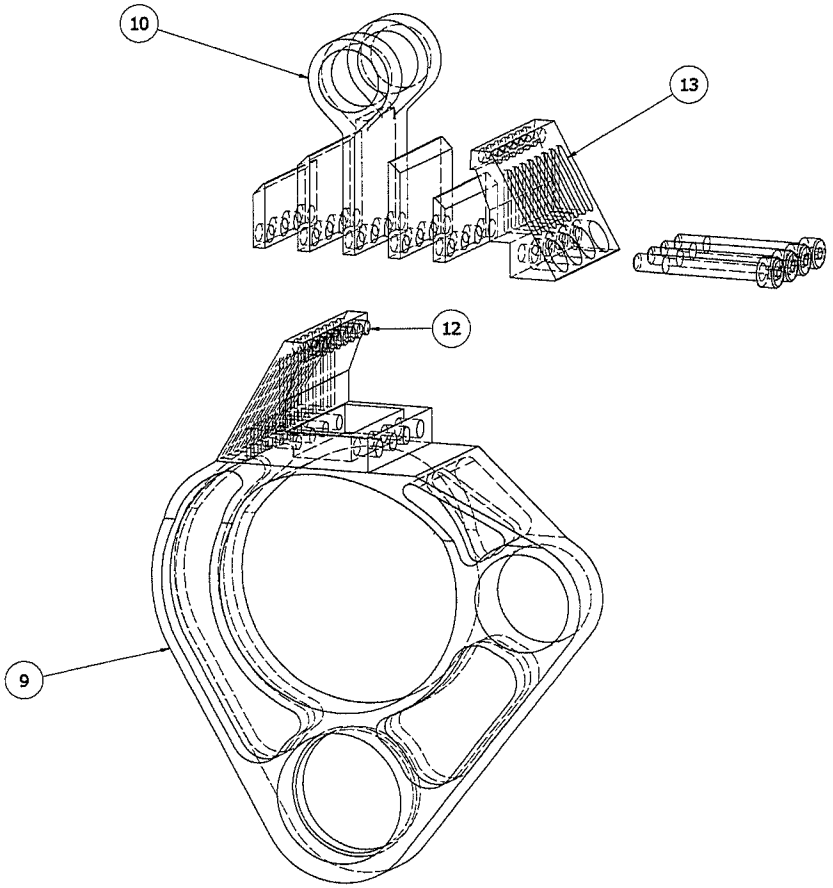

FIG. 17 show an exploded and see-through axonometric view of the lever as per FIG. 14 in which are highlighted:
the rigid part (9) of the lever;
the flexible part (10) of the lever;
the hydraulic pistons (12) that with their movement stop the bending of the flexible part (10) of the lever;
the side stops (13) that limit the bending of the flexible part (10) of the lever.

Figure 18:
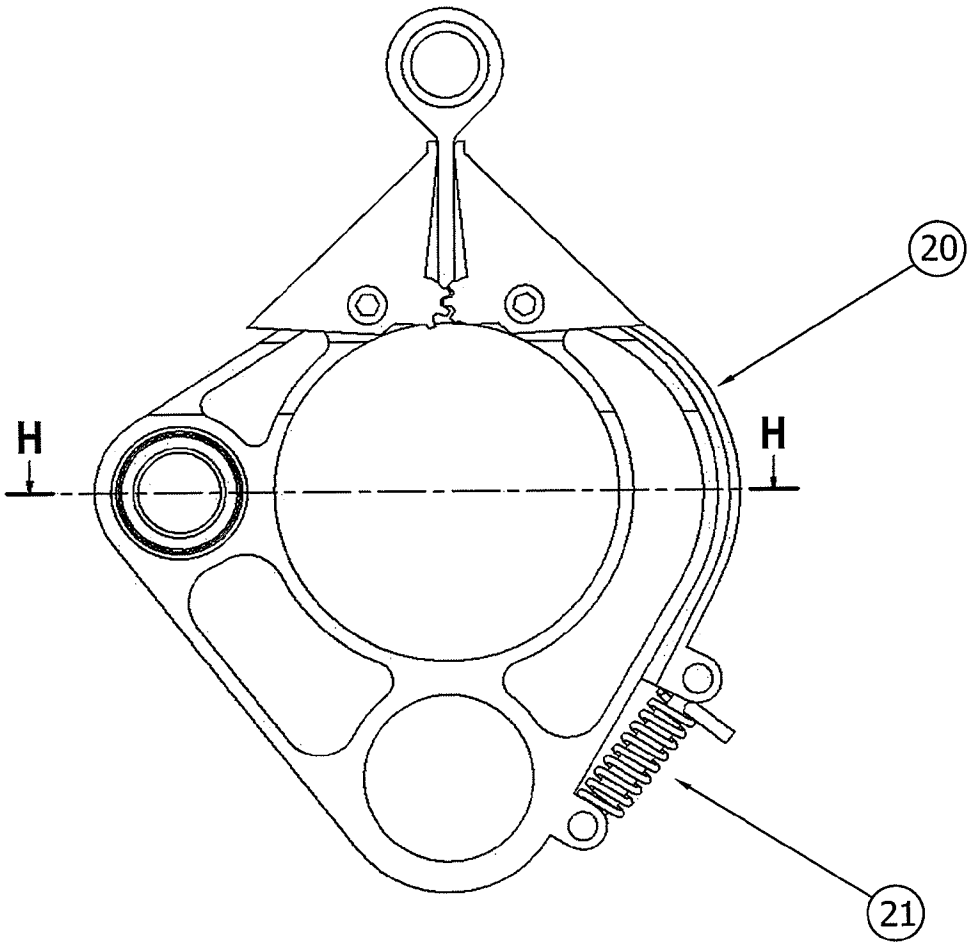
Figure 19:
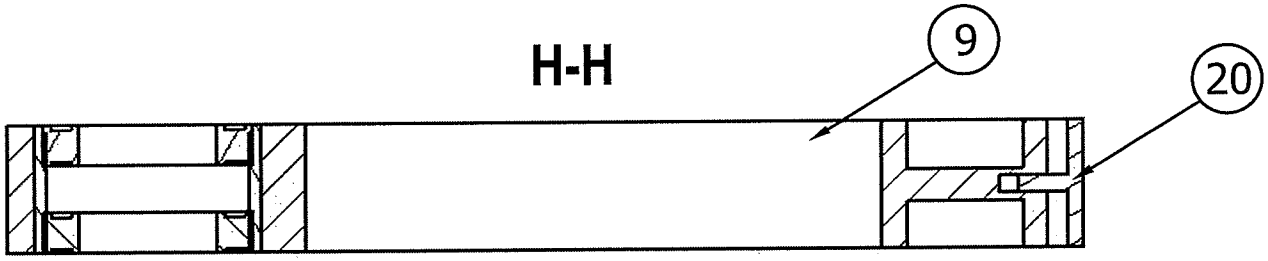

FIG. 18 shows:
a different embodiment of the mechanical stop for limiting the bending of the flexible part of the lever;
the horizontal section plane H-H, whose section is represented in FIG. 19;
VCR control lever (20);
hydraulic piston (21) for VCR control lever.

FIG. 19 shows:
section H-H of the lever as indicated in FIG. 18;
the rigid part (9) of the lever;
VCR control lever (20).

Figure 20:
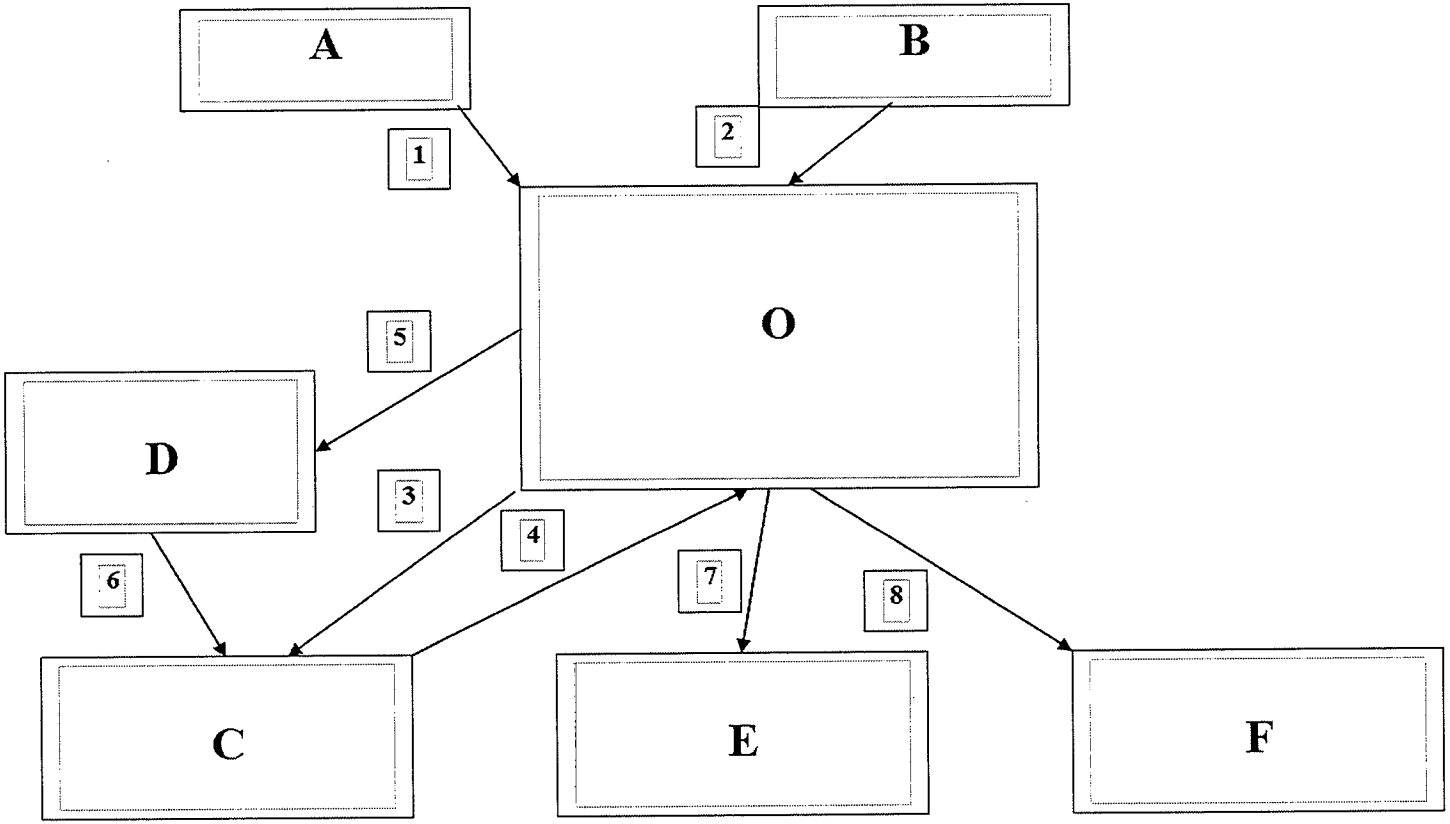

FIG. 20 shows a diagram of the electronic engine control system in which are indicated with the following letters:
O: electronic control unit;
A: piezoelectric sensor placed in the combustion chamber to measure the pressures generated by combustion;
B: carburettor throttle valve;
C: hydraulic pistons;
D: hydraulic pump for operating the hydraulic pistons;
E: electronic injection system;
F: electronic ignition system.

Figure 21:
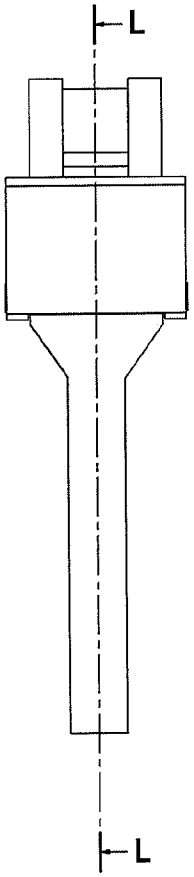
Figure 22:
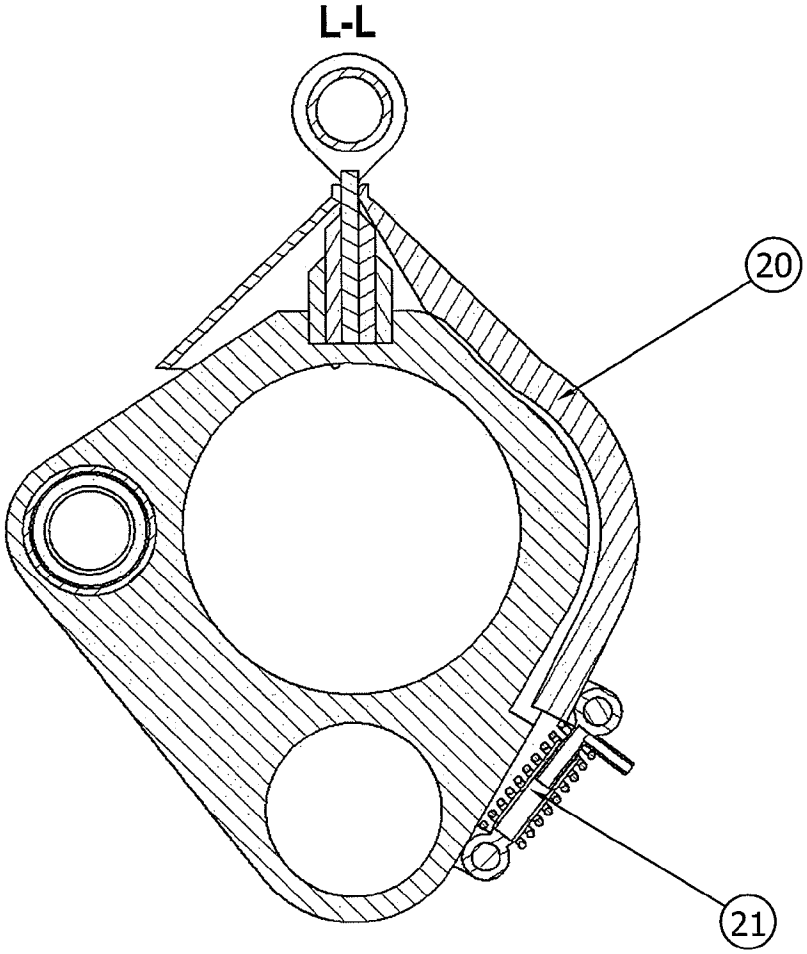

FIG. 21 shows:
a side view of the lever of the mechanical system of linking to the master connecting rod for transmission of the motion of the pistons complete with the elastic part;
the section plane of the lever L-L, whose section is shown in FIG. 22.

FIG. 22 shows:
the section of the lever, with a different system of control of the elastic part, according to plane L-L of FIG. 21;
VCR control lever (20);
hydraulic piston (21) for VCR control lever.

Figure 23:
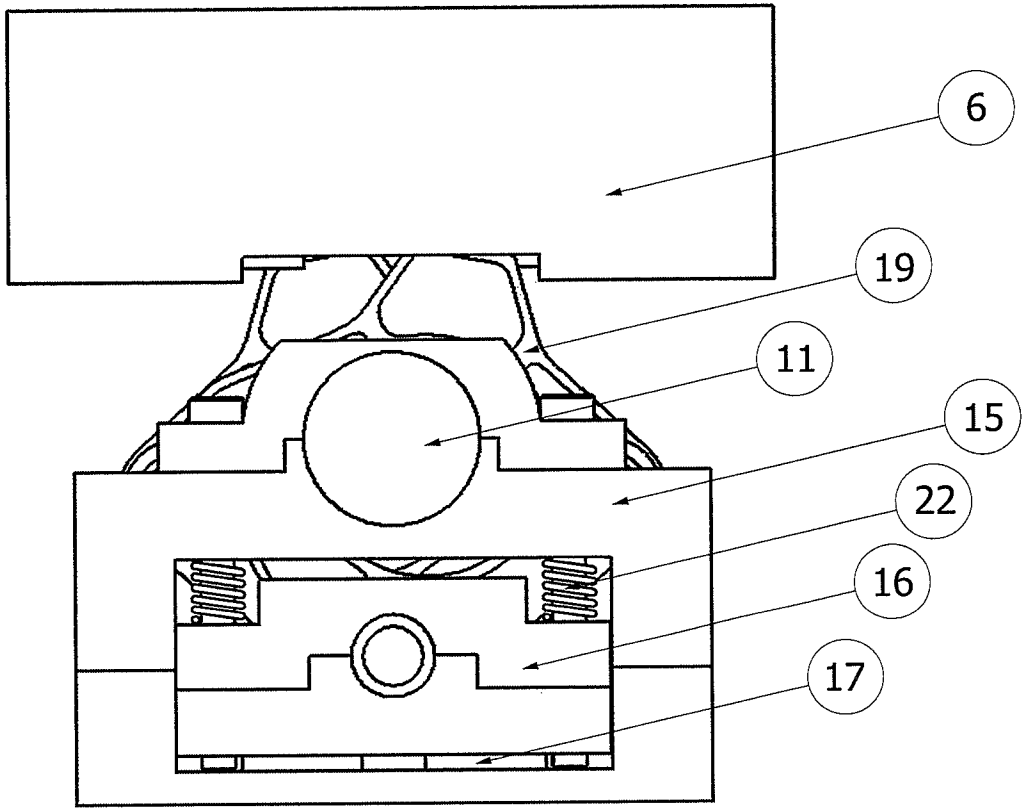

FIG. 23 shows a front view, on the axis of the crankshaft, of the internal combustion engine with a controlled variable compression ratio without the elastic part in the lever, in which are highlighted:
the cylinder (6);
the crankshaft (11);
the fixed bedplate (15) of the engine that supports the moving bedplate (16) on which the rigid rhomboidal lever (19) without the elastic part is pivoted;
the moving bedplate (16) on which the lever is pivoted;
the hydraulic pistons (17) that move the moving bedplate (16);
the springs (22) that tend to reposition the moving bedplate (16) as the hydraulic pistons (17) retract;
the rigid rhomboidal lever (19) without the elastic part.

Figure 24:
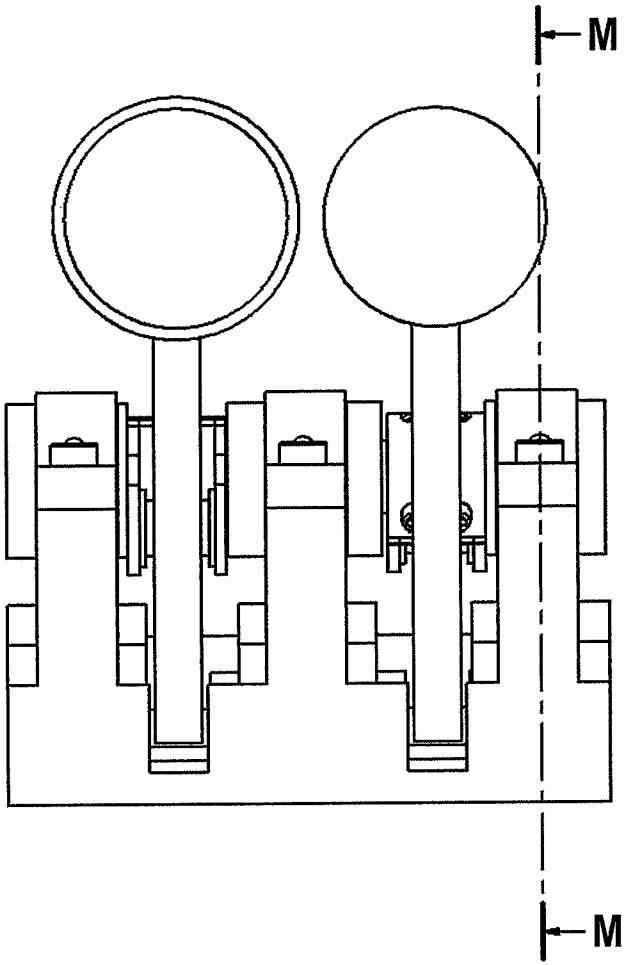

FIG. 24 shows a side view of an internal combustion engine with the mechanical system of linking to the master connecting rod without the elastic part, with section plane M-M.

Figure 25:
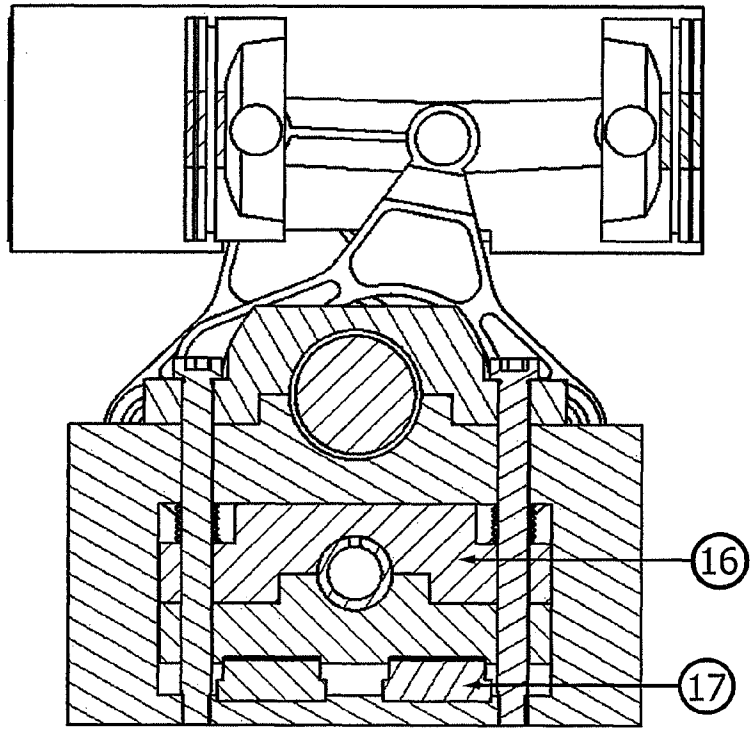

FIG. 25 shows a section view according to plane M-M of FIG. 24 of the mechanical system of linking to the master connecting rod without the elastic part (10) in maximum compression ratio position, in which are highlighted the hydraulic pistons (17) that move the moving bedplate (16).

Figure 26:
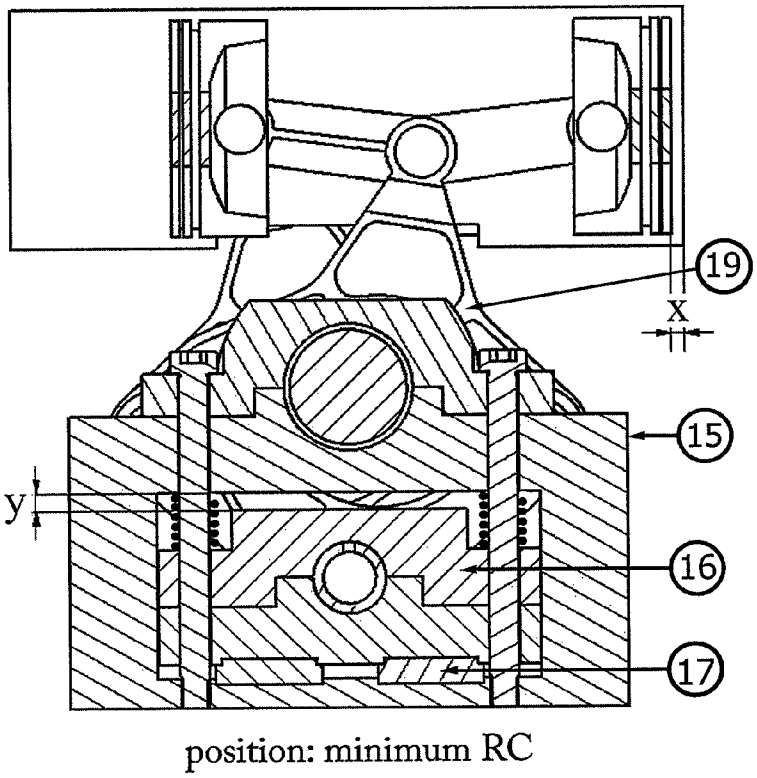

FIG. 26 shows a section view according to plane M-M of FIG. 24 of the mechanical system of linking to the master connecting rod without the elastic part (10) in minimum compression ratio position, in which are highlighted:

- the hydraulic pistons (17) that move the moving bedplate (16);
- the fixed bedplate (15) of the engine that supports the moving bedplate (16) on which the rigid rhomboidal lever (19) without the elastic part is pivoted;
- the correlated movements X and Y that cause the changing of X and the CR as Y changes.

DETAILED DESCRIPTION OF THE INVENTION

According to a preferred—but non-limiting—embodiment, the present invention concerns a mechanical system of linking to the master connecting rod for transmission of the motion of the pistons of an internal combustion engine to the crankshaft for transmitting motion to the power take off point of the engine that allows the compression ratio (CR) to be changed and controlled simply at each engine rotation cycle. It consists of a lever that can be completely rigid or made up of a flexible part (10) and a rigid part (9), and a connecting rod (7) that rotates a crankshaft (11); two coaxial pistons (8) with opposed heads that act in the same cylinder (6) and have opposed combustion chambers are connected by two small connecting rods (7) at the top of the lever, which has its fulcrum in the fixed bedplate (1) of the engine. The fulcrum of the rigid part (9) is situated in the fixed bedplate (1) of the engine and is held by the block (2) of the axis of the lever fulcrum pin (4) and secured by clamping bolts (3). The crankshaft (11) is situated and kept on an engine mount consisting of two bearings: the lower bearing (5) and the upper bearing (14).

The system consists in connecting two pistons (8) with intermediate connection elements (small connecting rods—integral pistons) that basically makes them a single element in reciprocating motion; this transmits the movement to a lever that, via a connecting rod (7), rotates the crankshaft (11). The system can therefore be considered as consisting of four elements (integral pistons, lever, connecting rod, crankshaft) for every two pistons (8), with an obvious general kinematic saving.

The system which is the subject of the present patent application uses a transmission lever that can be made in a single rigid piece or it can consist of two parts: a flexible part (10) that, specially calculated with two coupled half leaf springs, absorbs most of the stresses, thereby limiting the bending stresses of the rest of the lever; a rigid part (9) that, on the contrary, has a rhomboid shape that gives it considerable rigidity, so allowing the system to last for a time that can be considered commercially valid by industry, namely that it can last on a vehicle for at least 20,000 hours at 3000 revolutions/minute. The rigid part (9) of the lever is calculated to work especially under compression and traction and has an opening in its centre that allows the crankshaft (11) to be placed in a symmetrical position to the pistons/lever system.

Therefore, the transmission lever is either rigid or made up of two parts:

- the rigid part (9) for connection to the fulcrum and to the connecting rod that transmits motion to the crankshaft (11) and that, because of its particular rhomboid shape, gives considerable rigidity and lightness to the system;
- the flexible part (10) that is the part for connection to the pistons (8) and consists of two coupled half leaf springs to absorb most of the pulses, thereby suitably limiting the bending of the rest of the system.

The rigid rhomboidal part (which has a rhomboid-like shape) (9) of the lever allows the positioning of the crankshaft (11) on the vertical axis of the fulcrum of the lever and allows the movement of the pistons (8) to be slightly modifiable compared to the movement of the lever and of the crankshaft (11), that is to say it allows the top dead centre of the pistons to be staggered compared to the top dead centre of the lever by changing the volume of the combustion chamber. This staggering, therefore, due in particular to the flexible part (10) of the lever, allows the real compression ratio of the engine to be changed as the load and opening condition of the engine carburettor throttle valve changes.

The bending of the flexible part (10) of the lever causes variation of the compression ratio (CR) in proportion to the changing of the number of revolutions due to the pistons (8) coming near the roof of the combustion chamber, because of the forces of inertia, thereby reducing its actual volume. Without an effective control, this phenomenon makes it not possible to use the system as previously designed.

The system that is the subject of the present patent application uses flexibility in its favour. The flexibility of the flexible part (10) of the lever is controlled by two side stops (13) which are placed in both its sides forming part of the rigid part (9) of the lever. The said side stops (13) limit deformation within the maximum allowable deformation of the materials, thereby not allowing the change from the elastic phase to the plastic phase in which materials no longer return to their initial shape after being subjected to an elastic deformation. The bending is controlled by some hydraulic pistons (12); these are inside the stops (13) and limit the amplitude of the bending of the flexible part (10) of the lever, thereby allowing the compression ratio to be changed and controlled at each cycle of the engine depending on appearance of knock, that is when, due to excessive pressure, the fuel explodes before the top dead centre of the piston, so creating a thrust opposite to the direction of the piston and causing the engine to stop and/or break. The mathematical compression ratio changes as the stroke of the pistons (8) changes, while the real compression ratio changes continuously depending on the volume of air and fuel put into the cylinder (6); in fact, if an engine works with the carburettor throttle valve not fully open, the real compression ratio decreases, so drastically reducing the efficiency of the engine with the consequent effect of increasing environmental pollution due to poor combustion of the gases that are not very compressed and are therefore burned with a slower combustion wave that compromises their complete combustion.

The system that is the subject of the present patent application tends to keep the real compression ratio optimum between the volume of the air/fuel mixture and the volume of the combustion chamber, so causing a considerable increase in the volumetric efficiency of the engine at medium and high speeds, with a considerable improvement in the torque curve. The same CR control result can be made through a mechanical system of linking to the master connecting rod for transmission of the motion of the pistons without the elastic part (10) by changing the position of the fulcrum of the lever. In this case, the moving bedplate (16) of FIG. 25, in which the fulcrum of the lever is placed, is moved by hydraulic pistons (17) or by camshafts. In general, the camshaft is a shaft with keyed eccentric parts, suitable for transmitting particular laws of motion to the elements that are in contact with it. In internal combustion engines, this is normally the shaft responsible for the distribution on which are mounted eccentrics, called "cams", forced onto a cemented steel pipe or forming a forged whole, which control the opening and closing of the valves; in our case, the cams control the raising and lowering of the moving bedplate (16) in which the fulcrum of the lever (19) is fixed. The correlated movements X and Y of FIG. 26 cause the changing of X, the variation of the volume of the combustion chamber and therefore of the CR, as Y changes. The raising of the cams is opposed by springs (22) that tend to reposition the moving bedplate (16) to re-modify the CR.

Control of the CR is needed when, at a higher demand for power from the engine with substantial filling of the cylinders (6), the CR tends to exceed the maximum limit allowed by the fuel, so leading to knock. Variation of the CR is controlled by a control unit that receives the value of the real pressure in the combustion chamber via a piezoelectric silicon crystal that, stressed by the pressure, emits an electrical pulse that changes when there is knock; the control unit acts so as to decrease the CR and other parameters, such as for example the spark advance of the spark plugs.

The control unit detects the position of the hydraulic pistons (12) via electromagnetic sensors placed in the stops (13). If the pressure is too low, the control unit allows greater bending of the flexible part (10) of the lever by moving through the decrease in oil pressure of the hydraulic system of the hydraulic pistons (12). This movement increases the stroke of the piston (8) and decreases the volume of the combustion chamber, with a consequent increase in the CR.

If the CR were too high, the control unit would aid the reverse operation by increasing the hydraulic pressure in the hydraulic pistons (12), by decreasing the bending of the elastic part (10) and therefore decreasing the CR.

The hydraulic pistons (12) are controlled by a hydraulic circuit that, through the foot of the lever near the fulcrum (the fulcrum axis is practically motionless), ensures that the oil goes up to the stops (13) and the hydraulic pistons (12), via steel tubes, by positioning them as defined by the program of the control unit that controls their actual position via electromagnetic sensors.

By changing, the compression ratio remains optimal, decreasing at a low number of revolutions when filling of the cylinders (6) is more complete and increasing at a high number of revolutions when filling of the cylinder does not exceed 60-70%; this allows the power torque curve to be optimized, with a reduction of consumption and pollution at all speeds.

If one wishes to obtain higher specific powers, the system also allows exploitation of knock: practical testing has shown that the CR can amply exceed the maximum CR allowed by the fuel used. In fact, in a conventional engine, because of its rigidity, the piston must reach the top dead centre (TDC) when knock occurs by creating opposing forces that cancel each other out and overpressures that tend to stop the engine, thereby compromising its integrity with pressures of over 200 bar. In the case of the described system, these pressures can be controlled by keeping them within set limits (120/130 bar) since the flexible part (10) of the lever allows the piston (8) to start its return stroke while the lever completes its obligatory stroke up to its TDC and returns the elastically accumulated energy immediately afterwards (this all takes place in the space of tenths of mm and in times of thousandths of a second), with the effect of incredibly increasing the delivered power and its fluidity, with further improvement of consumption and reduction of pollution. This phenomenon takes place since, as the CR increases and as knock is initiated, a first flame front is ignited that is followed immediately afterwards by the flame front initiated by the spark plug. The two flame fronts jointly considerably increase the pressure and allow a much faster explosion in the combustion chamber that causes a thrust that makes the pressure go from 80 bar to 120/150 bar with the same fuel and therefore with a considerably higher efficiency.

The flexible part (10) of the lever, in high efficiency engines, allows so-called knock to be exploited due to pre-ignition of the mixture when the CR is too high for a given fuel; in conventional systems, this phenomenon tends to stop the engine, thereby also compromising its integrity.

The knock phenomenon is exploited in the present invention with the advantage of achieving higher power, lower pollution and lower consumption. In known engines, when knock occurs, the piston (8) is obliged to reach the TDC by opposing the pressure created by pre-ignition of the mixture and reaching pressures of 200 bar; in the present invention, in fractions of a millimeter and thousandths of a second, the elastic part (10) allows the piston (8) to begin its return stroke before its TDC in normal ignition conditions, yet allowing the rigid part (9) of the lever to complete the cycle and go through its TDC without reaching destructive pressures, but allowing the generated overpressures to be used. The greater energy generated accumulates in the flexible part (10) of the lever that returns it to the engine immediately after going past the TDC of the rigid part (9) of the lever. In this new cycle, the advantage is given by ignition due to the spark plug immediately after knock. The presence of two flame fronts in the combustion chamber accelerates the combustion times and so further increases the thrust pressures that generate higher engine torque and power with the same quantities of mixture, thereby reducing consumption and pollution for the same power.

The engine has a system of control through an electronic control unit that controls the CR by decoding the pulse, which changes as the pressure changes, given by a piezoelectric silicon sensor placed inside the combustion chamber of the engine and by the sensor placed in the carburettor that indicates the amount of opening of the throttle valve that determines the flow of air in the cylinder (6). When the pulses transmitted to the control unit change, the control unit acts through a hydraulic pump D on the hydraulic pistons (12) that bring about the bending of the flexible part (10) of the lever for linking to the master connecting rod, so changing the CR. At the same time, as the said parameters change, the control unit changes the spark advance of the engine and the fuel injection quantity and times to form the fuel mixture. If the engine is preset to withstand higher combustion pressures, the control unit manages the knock phenomenon by allowing it and controlling the pressures generated within the design limits.

The pressure pulses in the combustion chamber and the position of the carburettor are detected and processed by a control unit that, depending on the parameters entered in the program, controls the position of the hydraulic pistons (12) and repositions them by acting on a hydraulic pump, to have the maximum CR allowed by the design engineer, and at the same time manages the spark advance of the spark plugs and the fuel injection quantity and times to form the fuel mixture.

The bending of the elastic part (10) of the lever (which is calculated and preset for each type of specific engine), besides the compression ratio, changes the suction capacity of the pistons (8) that carry out a longer suction stroke when the number of revolutions increases.

Reduction of the rotating masses and the symmetry of pistons and opposed levers with a cycle of explosions at 90° on the same axis and on the same plane drastically reduce the 1st level vibrations and exclude the need for important stabilizer flywheels for continuity of the cycle with weight and mass reduction.

The very small crankshaft (11) (⅓ of conventional ones) decreases the torsional torques and longitudinal bending moments, so reducing 2nd level vibrations. The small crankshaft (11) reduces the engine spinning moments, friction and consumption of fuel and materials.

The vicinity of the cylinder (6) liners and the compactness of the crankshaft (11) entail a reduction of its bearings.

Changing the ratio between dimensions (A) and (B) of the lever (FIG. 14) changes the positioning of the point of connection of the connecting rod (7) to the lever and consequently therefore the forces generated on the pistons (8), which are applied to the connecting rod (7) and to the crankshaft (11), will be applied differently, so entailing a change in engine power delivery characteristics.

The wearing and use of a single sliding cylinder (6) for two pistons (8) drastically reduces the general dimensions of the engine and, considering that practically the whole cylinder (6) can be enveloped in coolant, paradoxically, with a correct cooling system, improves the possibility of lubricating and cooling the engine.

The electronic ignition system must be calibrated in order to optimize ignition based on the compression ratio and the changing of the top dead centre at the moment of explosion.

Method of calculating the flexible part (10) of the lever:

The procedure used for sizing the leaf spring flexible part (10) of the lever that supports the connecting rod (7) at the engine is as follows:

1) The area moment of inertia of the section at the fixed end, called J ($mm^4$), is calculated of the individual plate that will then be divided into several leaves.

By definition, J=(P*L3)/(2*E*f) where J is expressed in $mm^4$ with:

P=applied load (N)

L=length of the leaf (mm)

E=bending modulus of elasticity. In steels this is about 21000 $N/mm^2$.

F=deflection (mm)

2) After calculating J, area moment of inertia of the section at the fixed end, the thickness of the plate H is calculated assuming as σallowable, for dynamic stresses, as the one applied to our lever, equal to 0.4 σyield. Consider that for alloyed steel, σyield is about 1050 $N/mm^2$.

$$H=(2*\sigma allowable*J)/(P*L)\ (mm)$$

where:

J=area moment of inertia of the section at the fixed end ($mm^4$)

σallowable=0.4 σyield ($N/mm^2$)

P=applied load (N)

L=length of the leaf (mm)

3) Now the maximum width B of the triangular leaf can be calculated using the following formula:

$$B=(L2*J)/H^3$$

where:

J=area moment of inertia of the section at the fixed end ($mm^4$)

H=thickness of the plate (mm)

Once the aforesaid parameters have been calculated, the "theoretical" plate has been sized.

To obtain the real leaf spring, the theoretical triangular leaf must be divided into a series of strips that will then be superimposed.

By consulting the UNI3960 standards, the combination of real leaves sized correctly in relation to the parameters calculated above is obtained.

For the leaf spring of the present invention, the calculation must consider the element formed by two "leaf spring systems" which will have in common the longest central element that, depending on the stresses, will involve the shortest leaves on the left or the right in the bending independently of each other with symmetrical and opposed loads.

4) Once the real sizing of the leaf spring has been obtained, a check is carried out by assessing the actual tension acting on the trapezoidal leaf taking into account the number of leaves and the sizing obtained:

for the actual tension acting on an individual leaf, the following formula is used:

$$\sigma=(6*P*L)/(n*b*H^2)$$

where:

P=applied load (N)

L=length of the leaf (mm)

b=width of the leaf (mm)

H=thickness of the leaf (mm)

N=number of leaves for the calculation of the real deflection, the following formula is used:

$$f=\eta*(4*P*L^3)/(E*n*B*H^3)$$

these are all coefficients except for η=b'/b where b' is the width of the individual leaf and where b is the width of all the leaves.

After the leaf spring has been sized and tested statically, it must be "fatigue" tested to determine the resistance of the flexible part (10) of the lever over time.

To have a theoretically unlimited life, the elastic load cycle of the element that indicates how many "n" times the two half leaf springs can bend without becoming permanently deformed, must remain within the Goodman-Smith diagram.

After the characteristics of the material have been fixed:

σyield that in alloyed steels is about 1050 $N/mm^2$;

Δσ that in alloyed steels is about 300 $N/mm^2$, the fatigue diagram can be calculated and the degree of safety assessed according to the distance of the top of the sinusoid of the load cycle from the limit determined by the Goodman-Smith graph which indicates the extreme load cycle.

All the above can be obtained, in particular, for turbo compressed engines with the movement of the fulcrum of the rigid lever without flexible part; this movement brings about a change of the position of the top dead centre of the pistons without altering their stroke. The movement of the fulcrum of the lever is obtained by positioning it on a part of the bedplate of the engine to which is given the possibility of moving supported by cams or by some hydraulic pistons that guide them and constrains the movement managed by the electronic control unit that processes the data received from the piezoelectric sensor placed in the combustion chamber of the pistons.

The materials and dimensions of the invention as described above, illustrated in the accompanying drawings and claimed below, can be of any kind according to requirements. Moreover, all the details can be replaced with other technically equivalent ones without for this reason straying from the protective scope of the present patent application.

I claim:

1. A system comprising:

an internal combustion engine having a piston, said piston having a motion;

a connecting rod connected to and extending from said piston;

a crankshaft connected to said connecting rod so as to be rotated by a connecting rod;

an engine mount having a lower bearing and an upper bearing, said crankshaft supported on said engine mount;

a lever having a flexible part and a rhomboid-shaped rigid part, said flexible part connected to said piston; and a moving bedplate having an up-and-down motion, said rhomboid-shaped rigid part placed on said moving bedplate such that said up-and-down motion of said moving bedplate and said lever allows a compression ratio of said internal combustion engine to be varied.

2. The system of claim 1, said crankshaft positioned on a vertical axis of said lever, the motion of said piston being adjustable relative to the movement of said lever and said crankshaft.

3. The system of claim 1, said flexible part of said lever being bendable so as to change the compression ration relative to the motion of said piston.

4. The system of claim 1, further comprising:

a pair of side stops positioned on opposite sides of said rigid part and extending toward said flexible part so as to limit a bending of said flexible part.

5. The system of claim 4, further comprising:

a hydraulic piston cooperative with at least one of said pair of side stops so as to limit the bending of said flexible part.

6. The system of claim 5, further comprising:

an electronic silicon sensor positioned within a combustion chamber of said internal combustion engine, said piezoelectric silicon sensor emitting a pulse; and a carburetor sensor positioned in a carburetor and adapted to sense an opening of a throttle valve for controlling a flow of air in the combustion chamber, said electronic control unit cooperative with said piezoelectric silicon sensor and said carburetor sensor so as to decode the pulse of said piezoelectric silicon sensor and to detect a movement of said hydraulic piston so as to control the compression ratio.

7. The system of claim 6, further comprising:

a hydraulic circuit connected to said hydraulic piston so as to pass hydraulic fluid to said pair of stops and said hydraulic piston relative to a control signal from said electronic control unit.

* * * * *